US010181661B2

(12) United States Patent
Manba

(10) Patent No.: US 10,181,661 B2
(45) Date of Patent: Jan. 15, 2019

(54) CABLE CONNECTOR

(71) Applicant: KYOCERA Corporation, Kyoto-shi, Kyoto (JP)

(72) Inventor: Yousuke Manba, Yokohama (JP)

(73) Assignee: KYOCERA Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 15/529,157

(22) PCT Filed: Jul. 16, 2015

(86) PCT No.: PCT/JP2015/070350
§ 371 (c)(1),
(2) Date: May 24, 2017

(87) PCT Pub. No.: WO2016/092894
PCT Pub. Date: Jun. 16, 2016

(65) Prior Publication Data

US 2017/0331206 A1 Nov. 16, 2017

(30) Foreign Application Priority Data

Dec. 9, 2014 (JP) ..... 2014-248952

(51) Int. Cl.
*H01R 13/62* (2006.01)
*H01R 12/61* (2011.01)
(Continued)

(52) U.S. Cl.
CPC ..... *H01R 12/61* (2013.01); *H01R 12/7023* (2013.01); *H01R 12/716* (2013.01);
(Continued)

(58) Field of Classification Search
CPC ..... H01R 12/88; H01R 12/7023; H01R 12/61
(Continued)

(56) References Cited

U.S. PATENT DOCUMENTS 6,224,418 B1 5/2001 Miura et al.
7,473,125 B2 * 1/2009 Murakami ..... H01R 12/592 439/260
(Continued)

FOREIGN PATENT DOCUMENTS

CN 1272701 A 11/2000
CN 101390257 A 3/2009
(Continued)

OTHER PUBLICATIONS

Oct. 13, 2015, International Search Report issued in the International Patent Application No. PCT/JP2015/070350.
(Continued)

*Primary Examiner* — Abdullah Riyami
*Assistant Examiner* — Nelson R Burgos-Guntin
(74) *Attorney, Agent, or Firm* — Kenja IP Law PC

(57) ABSTRACT

A cable connector that can, when an external force in a curling-up direction acts on a cable inserted in an insulator in a state where an actuator is in a closed position, prevent the cable from disconnecting from the insulator in the curling-up direction without deformation or breakage of the connector. A cable connector includes: an insulator (20) into which a sheet-like cable (70) is removably insertable; a contact (30) supported by the insulator; a rotatable actuator (40); and a fixed metal fitting (55) fixed to the insulator. The fixed metal fitting includes a cable press piece (61) extending from a part of the fixed metal fitting and facing the cable. The cable press piece is plate-like. The insulator includes a facing portion (28*a*) facing a tip part of the cable press piece from a side opposite to the cable at least when the actuator is in the closed position.

4 Claims, 8 Drawing Sheets

(51) Int. Cl.

| | |
|---|---|
| ***H01R 12/79*** | (2011.01) |
| ***H01R 12/70*** | (2011.01) |
| ***H01R 12/88*** | (2011.01) |
| ***H01R 12/71*** | (2011.01) |
| ***H01R 12/77*** | (2011.01) |

(52) U.S. Cl.
CPC ..... *H01R 12/774* (2013.01); *H01R 12/79* (2013.01); *H01R 12/88* (2013.01)

(58) Field of Classification Search
USPC ..... 439/267, 260, 329, 345, 493, 495
See application file for complete search history.

(56) References Cited

U.S. PATENT DOCUMENTS

| | | | | |
|---|---|---|---|---|
| 7,887,351 | B2 * | 2/2011 | Wang | H01R 12/88 439/260 |
| 7,909,639 | B2 | 3/2011 | Hirata et al. | |
| 8,840,411 | B2 | 9/2014 | Nakano | |
| D800,070 | S * | 10/2017 | Manba | D13/147 |
| 9,859,639 | B2 * | 1/2018 | Tagami | H01R 12/88 |
| 2009/0221178 | A1 | 9/2009 | Hirata et al. | |
| 2009/0269968 | A1 * | 10/2009 | Nemoto | H01R 12/88 439/377 |
| 2009/0318001 | A1 * | 12/2009 | Hemmi | H01R 12/771 439/260 |
| 2010/0227491 | A1 * | 9/2010 | Tsai | H01R 23/661 439/260 |
| 2011/0151682 | A1 * | 6/2011 | Kodaira | H01R 12/594 439/55 |
| 2011/0275238 | A1 * | 11/2011 | Iijima | H01R 12/88 439/492 |
| 2012/0231646 | A1 | 9/2012 | Nakano et al. | |
| 2014/0357111 | A1 | 12/2014 | Nakano | |
| 2016/0141785 | A1 * | 5/2016 | Yokoo | H01R 12/88 439/733.1 |
| 2017/0062963 | A1 * | 3/2017 | Tagami | H01R 12/88 |
| 2017/0331206 | A1 * | 11/2017 | Manba | H01R 12/61 |

FOREIGN PATENT DOCUMENTS

| | | | |
|---|---|---|---|
| JP | 2004192825 | A | 7/2004 |
| JP | 2006134709 | A | 5/2006 |
| JP | 2007123057 | A | 5/2007 |
| JP | 2012151021 | A | 8/2012 |

OTHER PUBLICATIONS

Oct. 13, 2015, Written Opinion of the International Searching Authority issued in the International Patent Application No. PCT/JP2015/070350, with English language Concise Explanation.

* cited by examiner

CABLE CONNECTOR

TECHNICAL FIELD

The disclosure relates to a cable connector.

BACKGROUND

An FPC (flexible printed circuit board) connector in JP 2004-192825 A (PTL 1) includes: an insulator made of resin and having a cable insertion groove into which an FPC having locked portions at both side edges is removably insertable; a plurality of contacts supported by the insulator in a state of being connected to a circuit board (rigid board); an actuator having a cam portion and rotatable between a closed position and an open position relative to the insulator; and a fixed metal fitting fixed to the insulator and the circuit board. FPC pressers located directly above the right and left side edges of the FPC when the FPC is inserted in the cable insertion groove are integrally provided on the right and left sides of the insulator.

When the FPC is inserted into the insulator in a state where the actuator is in the open position and then the actuator is rotated to the closed position, the actuator increases the contact pressure between the FPC and the contacts. This ensures conduction between the FPC and the contacts.

When an external force acts on the FPC in the direction of curling up from the insulator (away from the circuit board in the thickness direction of the circuit board) in a state where the actuator is in the closed position and the FPC is inserted in the insulator, the right and left side edges of the FPC engage with the pair of FPC pressers of the insulator. Accordingly, in the case where the force in the curling-up direction is not so strong, the FPC can be prevented from disconnecting from the insulator due to curling-up.

CITATION LIST

Patent Literature

PTL 1: JP 2004-192825 A

SUMMARY

Technical Problem

The pair of FPC pressers in PTL 1 are made of resin and are thin. Besides, each FPC presser is a cantilever arm-like portion that is fixed to the insulator (body) only at one end while the other end is a free end. The FPC presser thus does not have high mechanical strength.

The connector in PTL 1 also includes a reinforcing metal fitting for reinforcing the FPC presser made of resin. The reinforcing metal fitting includes an arm-like engaging portion whose tip part engages with the actuator. However, the connector does not have a structure of pressing the tip part (curl portion) of the engaging portion from above when the actuator is in the closed position. Consequently, the reinforcing metal fitting (engaging portion) may move in the curling-up direction due to the curling-up force of the FPC, and deform plastically or break.

There is thus a possibility that, in the case where a strong external force acts on the FPC in the curling-up direction, the FPC presser (connector) breaks due to the curling-up force of the FPC.

It could therefore be helpful to provide a cable connector that can, when an external force in a curling-up direction acts on a cable inserted in an insulator in a state where an actuator is in a closed position, prevent the cable from disconnecting from the insulator in the curling-up direction without deformation or breakage of the connector.

Solution to Problem

A cable connector according to the disclosure includes: an insulator having a cable insertion groove into and from which a sheet-like cable is insertable and removable; a contact supported by the insulator and coming into contact with the cable inserted in the insulator; an actuator rotatable between a closed position and an open position relative to the insulator; and a fixed metal fitting fixed to the insulator, wherein the fixed metal fitting includes a cable press piece extending from a part of the fixed metal fitting in an insertion direction of the cable and facing the cable from one side in a thickness direction of the cable, the cable press piece is shaped like a plate with a plate thickness direction parallel to the thickness direction of the cable, and the insulator includes a fixing portion fixing a tip part of the cable press piece or a facing portion facing the tip part from a side opposite to the cable, at least when the actuator is in the closed position.

The insulator may include a cable press piece insertion hole into which the tip part of the cable press piece is inserted, and a part of an inner surface of the cable press piece insertion hole may constitute the facing portion.

The actuator may include a rotation shaft as a rotation center thereof, and the fixed metal fitting may include a rotation shaft press piece facing the rotation shaft from the one side in the thickness direction of the cable.

The cable may include a locked portion, the actuator may include a stopper projection facing, from a side to which the cable is to be removed, the locked portion of the cable inserted in the cable insertion groove when the actuator is in the closed position, and the fixed metal fitting may include a stopper projection escape recess into which the stopper projection is freely fitted when the actuator is in the closed position.

Advantageous Effect

When an external force acts on the cable in the direction of curling up from the insulator in a state where the actuator is in the closed position and the cable is inserted in the insulator, the cable engages with the cable press piece of the fixed metal fitting.

The cable press piece is made of metal and resists deformation, and shaped like a plate having a large overlap area with the cable as seen in the thickness direction of the cable (the form of contact with the cable when the cable curls up tends to be surface contact).

Hence, when the external force acting on the cable in the curling-up direction is not strong, the cable press piece can prevent the cable from disconnecting from the insulator due to curling-up.

In the case where the insulator includes the facing portion, when the external force acting on the cable in the curling-up direction is strong, the cable press piece pressed by the cable deforms, and the tip part of the cable press piece engages with the facing portion. In detail, one end of the cable press piece is supported by part of the fixed metal fitting, and the other end (tip part) of the cable press piece is supported by the insulator (the cable press piece is in a double-support state). In the case where the insulator includes the fixing portion, (regardless of whether or not the cable curls up,) one end of the cable press piece is supported by part of the fixed metal fitting, and the other end (tip part) of the cable press piece is supported by the insulator (the cable press piece is in a double-support state).

When the cable press piece is in a double-support state, the cable press piece is less deformable or breakable (than in a cantilever state). Therefore, even in the case where the external force acting on the cable in the curling-up direction is strong, the cable is unlikely to disconnect from the insulator in the curling-up direction, and the possibility of breakage of the cable press piece (connector) is low.

In the case where the external force acting on the cable in the curling-up direction is strong, the cable may force the actuator in the closed position to rotate to the open position. Since the actuator absorbs the moving force of the cable through the rotation, however, the possibility of deformation or breakage of the actuator in such a case is low.

DETAILED DESCRIPTION

Figure 1:
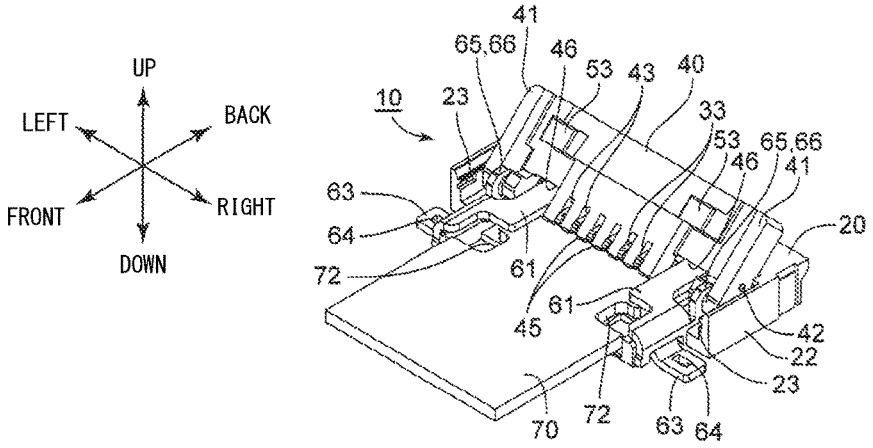
FIG. 1 is a perspective view of a connector with an actuator in an open position and an FPC whose back end is inserted in the connector as seen obliquely from front above, according to one of the disclosed embodiments.

The following describes one of the disclosed embodiments with reference to attached drawings. The directions such as front, back, right, left, up, and down in the following description are based on the arrow directions in the drawings.

A connector 10 in this embodiment includes an insulator 20, a signal contact 30, an actuator 40, and a fixed metal fitting 55, as main components.

Figure 6:
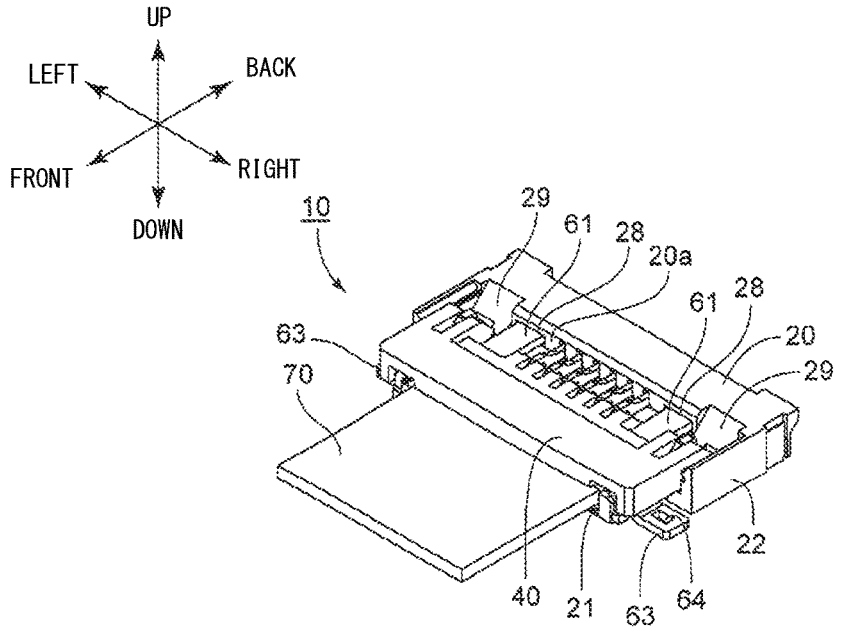
FIG. 6 is a perspective view of the connector with the actuator in a closed position and the FPC whose back end is inserted in the connector, as seen obliquely from front above.
Figure 7:
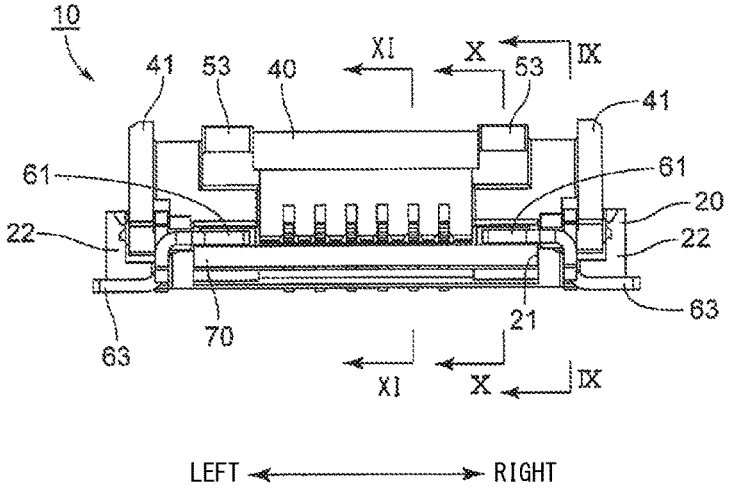
FIG. 7 is a front view of the connector with the actuator in the open position and the FPC whose back end is inserted in the connector.
Figure 8:
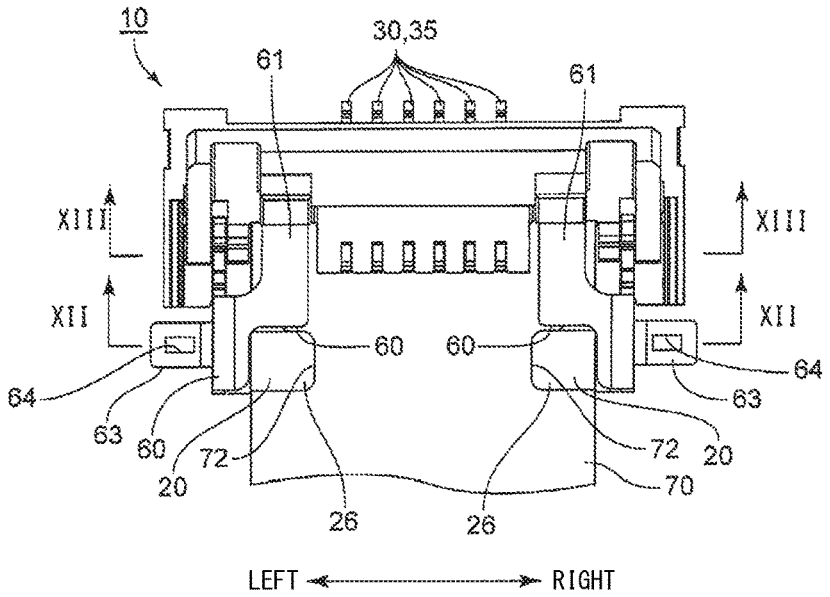
FIG. 8 is a plan view of the connector with the actuator in the open position and the FPC whose back end is inserted in the connector.
Figure 9:
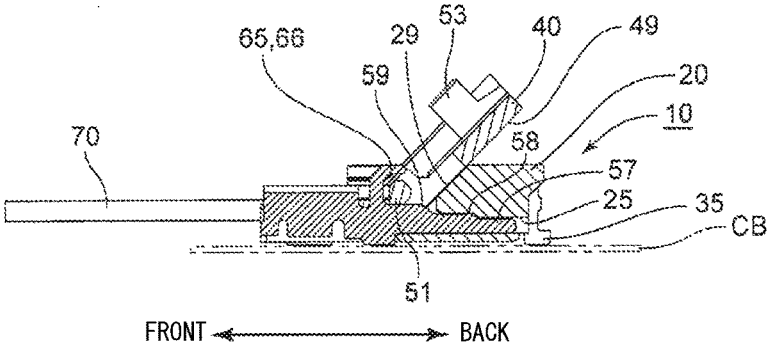
FIG. 9 is a sectional view along arrow IX-IX in FIG. 7.
Figure 15:
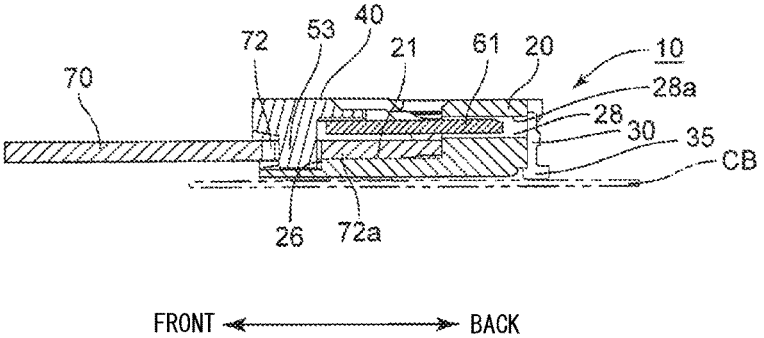
FIG. 15 is the same sectional view as in FIG. 10 when the actuator is rotated to the closed position.
Figure 16:
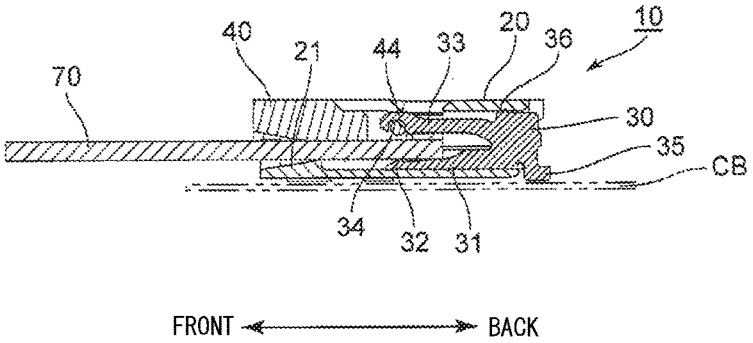
FIG. 16 is the same sectional view as in FIG. 11 when the actuator is rotated to the closed position.
Figure 17:
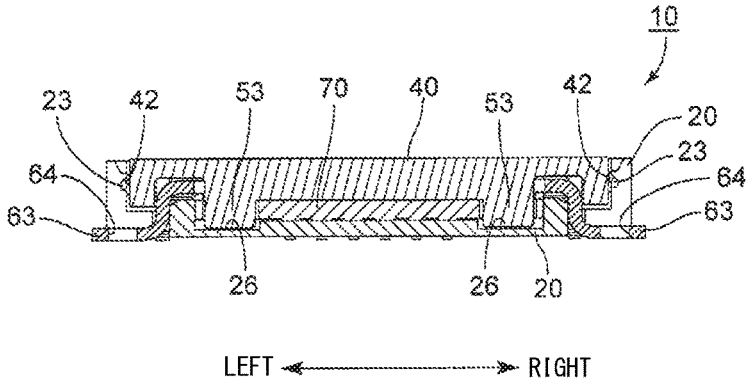
FIG. 17 is the same sectional view as in FIG. 12 when the actuator is rotated to the closed position.

The insulator 20 is formed by injection molding an insulating and heat-resistant synthetic resin material. A cable insertion groove 21 having substantially the same width as an FPC 70 (sheet-like cable, contact object) is formed in the front part of the upper surface of the insulator 20. The front surface and upper surface of the cable insertion groove 21 are open. A pair of side walls 22 are formed on the right and left sides of the insulator 20. A closed position holding recess 23 is formed at the front end of the inner surface of each of the right and left side walls 22. A pair of right and left arm housing recesses 24 just inside the right and left side walls 22 are formed near the right and left sides of the insulator 20. The insulator 20 includes a metal fitting fixing groove 25 located inside each of the right and left arm housing recesses 24 and extending in the front-back direction. The front surface of the metal fitting fixing groove 25 is open, and the upper and lower surfaces of the front part (the part formed in the arm housing recess 24) of the metal fitting fixing groove 25 are also open. The metal fitting fixing groove 25 extends more backward than the arm housing recess 24. The upper and lower surfaces and right and left surfaces of the back part (the part located more backward than the arm housing recess 24) of the metal fitting fixing groove 25 are blocked by the insulator 20, and its back end reaches the back end surface of the insulator 20 (see FIGS. 3, 9, and the like). A pair of right and left rotation regulation recesses 26 are formed at the front end of the upper surface of the cable insertion groove 21. Six contact insertion grooves 27 extending in the front-back direction are formed in the insulator 20. The back part of each contact insertion groove 27 passes through the back part of the insulator 20 in the front-back direction, and the front part of each contact insertion groove 27 is formed in the bottom surface of the cable insertion groove 21. A pair of right and left cable press piece insertion holes 28 are formed in a front end surface 20*a* of the back part of the insulator 20. The right and left cable press piece insertion holes 28 extend linearly backward, and have their back ends open at the back end surface of the insulator 20 (see FIGS. 3, 10, 15, and the like). Each cable press piece insertion hole 28 is substantially rectangular in cross section. A pair of right and left inclined support surfaces 29 are formed in the back part of the insulator 20 (see FIGS. 2, 6, 9, and the like).

Six signal contacts 30 (contacts) are formed by molding a sheet of a copper alloy (e.g. phosphor bronze, beryllium copper, titanium copper) or a corson copper alloy having spring elasticity using progressive dies (stamping) in the illustrated shape. The surfaces of the signal contacts 30 are nickel plated to form a base and then gold plated. As illustrated in FIGS. 2, 3, 11, 16, and the like, each signal contact 30 is substantially U-shaped in a side view, and includes: a contact arm 31 having a contact projection 32 at its tip; a press arm 33 located directly above the contact arm 31 and having a support recess 34 near the tip of its lower surface; and a tail piece 35 projecting from the back end.

Figure 11:
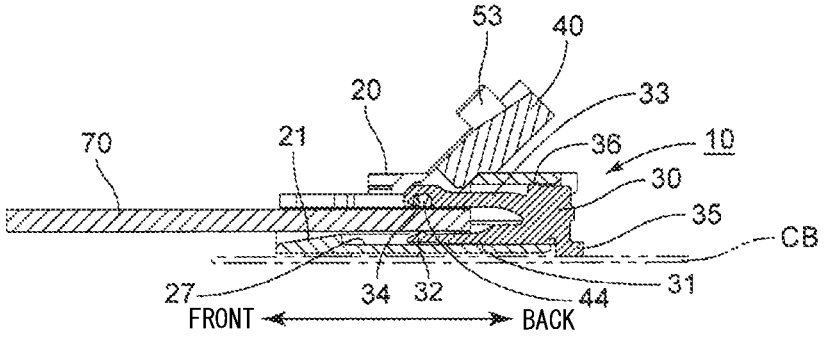
FIG. 11 is a sectional view along arrow XI-XI in FIG. 7.

Each signal contact 30 is press-fitted into the corresponding contact insertion groove 27 of the insulator 20 from behind. As illustrated in FIG. 11 and the like, when each signal contact 30 is press-fitted into the corresponding contact insertion groove 27, the contact arm 31 is located in the front part of the contact insertion groove 27 (the contact projection 32 is located inside the cable insertion groove 21), and a catching projection 36 formed in the upper surface of the press arm 33 digs into the upper surface of the contact insertion groove 27. This fixes the signal contact 30 to the contact insertion groove 27. The tail piece 35 projects backward from the insulator 20, with its lower surface being lower than the lower surface of the insulator 20.

Figure 14:
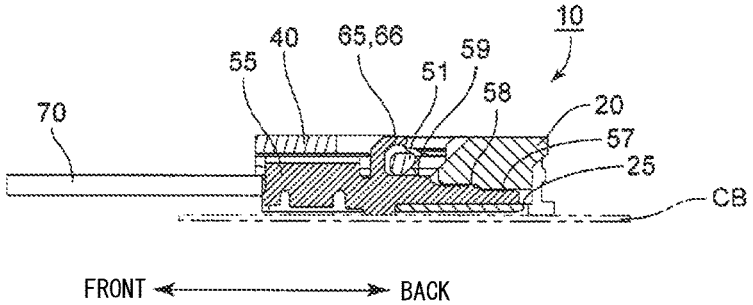
FIG. 14 is the same sectional view as in FIG. 9 when the actuator is rotated to the closed position.

The rotary actuator 40 which is a plate-like member extending in the right-left direction is formed by injection molding a heat-resistant synthetic resin material using metal forming dies. A side arm 41 is provided on each of the right and left sides of the actuator 40. A locking projection 42 is formed in the outer surface of each of the right and left side arms 41. Six arm insertion through holes 43 passing through the actuator 40 in the plate thickness direction are arranged in the right-left direction near the lower end of the center part of the actuator 40 in the width direction (the right-left direction). Directly below each arm insertion through hole 43, a center rotation shaft 44 blocking the lower end of the arm insertion through hole 43 is formed (see FIGS. 2, 11, and 16). Six cam portions 45 are provided at the lower ends of the parts between the adjacent arm insertion through holes 43. A pair of right and left metal fitting escape recesses 46 are formed at the lower end of the actuator 40. An open position holding surface 49 is formed in the back surface (the upper surface when the actuator 40 is in the closed position) of the actuator 40. A side through hole 50 passing through the actuator 40 in the plate thickness direction is formed near each of the right and left ends of the actuator 40, and a side rotation shaft 51 (rotation shaft) blocking the lower end of the side through hole 50 and coaxial with the center rotation shaft 44 is formed directly below the side through hole 50 (see FIGS. 2, 9, and 14). A pair of right and left stopper projections 53 are formed in the front surface (the lower surface when the actuator 40 is in the closed position) of the actuator 40.

Figure 2:
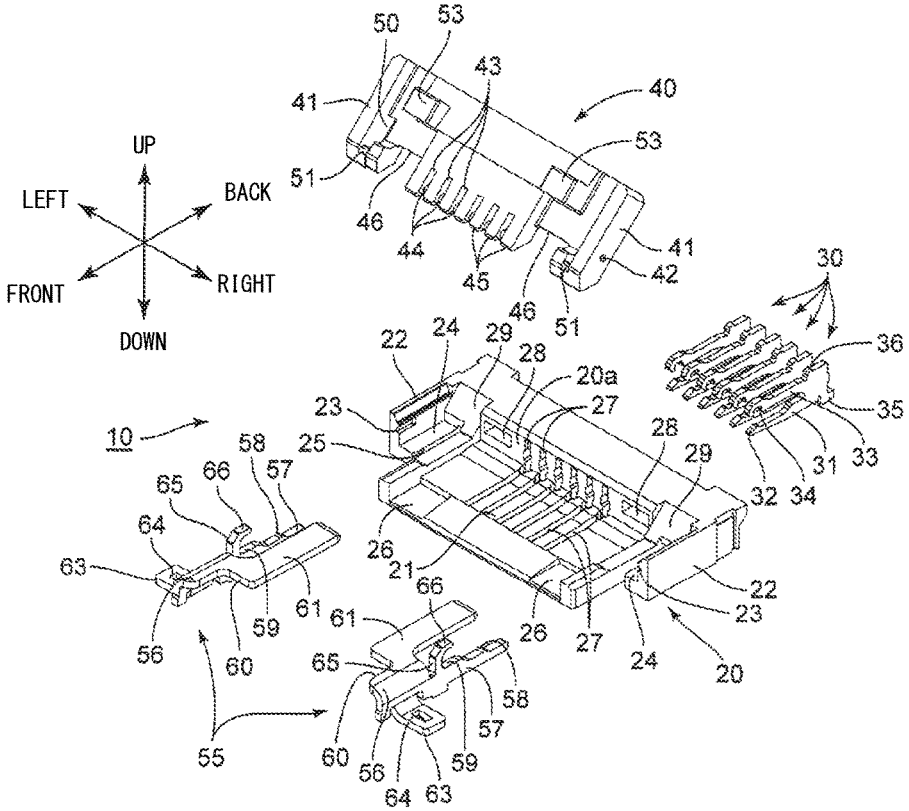
FIG. 2 is an exploded perspective view of the connector as seen obliquely from front above.
Figure 3:
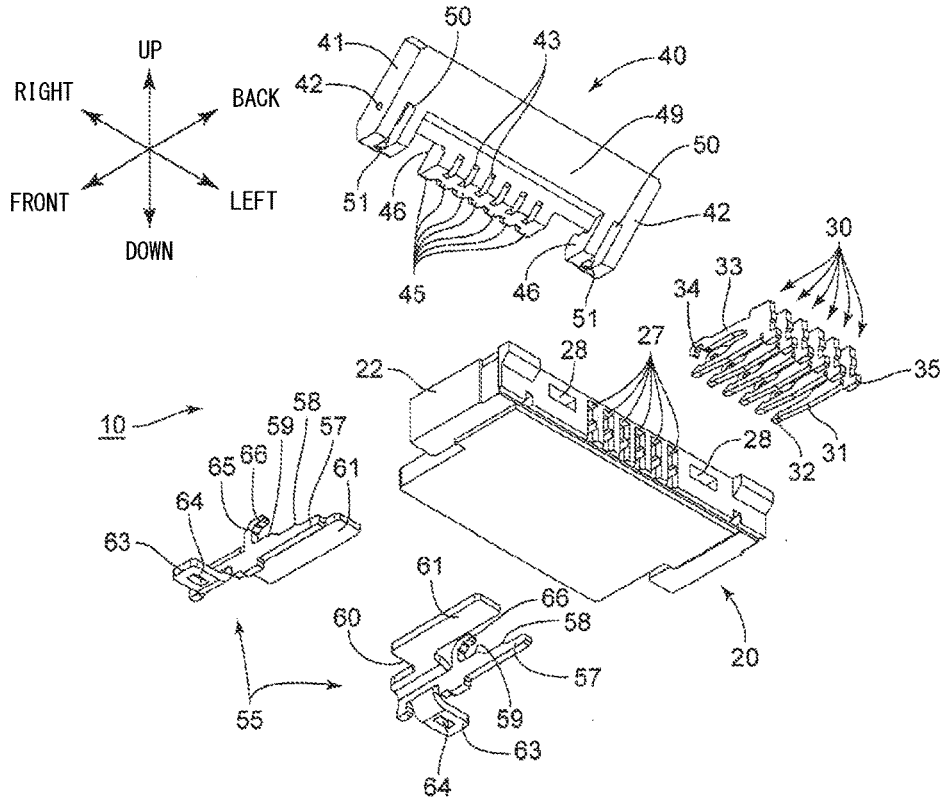
FIG. 3 is an exploded perspective view of the connector as seen obliquely from back below.
Figure 4:
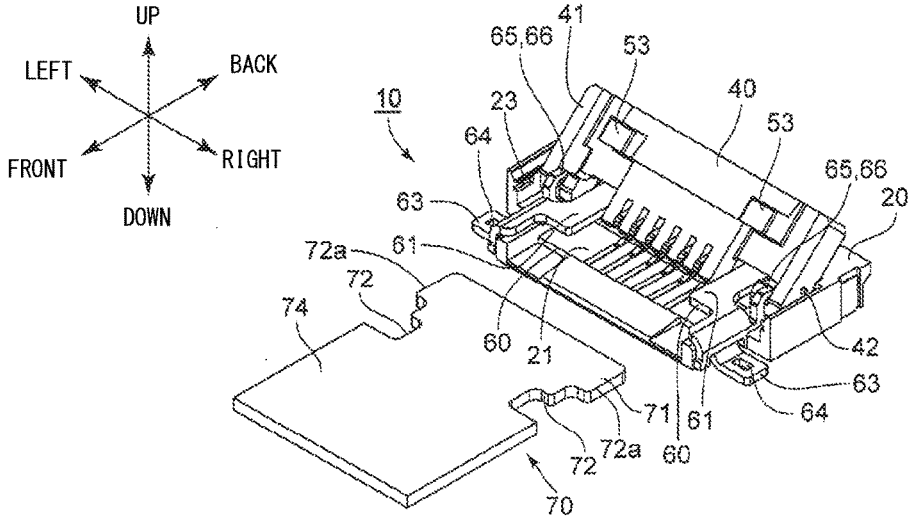
FIG. 4 is a perspective view of the connector with the actuator in the open position and the FPC in a separated state, as seen obliquely from front above.
Figure 5:
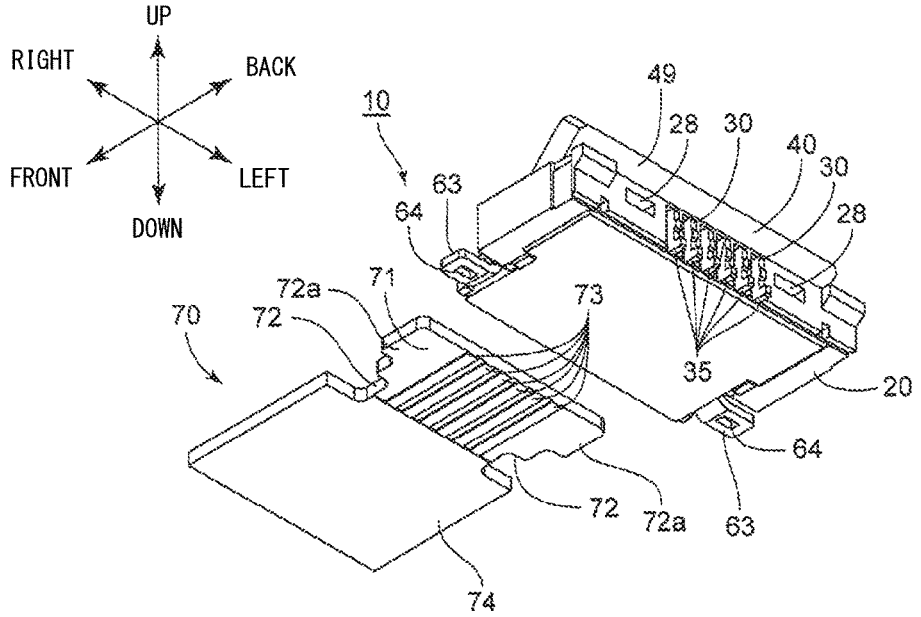
FIG. 5 is a perspective view of the connector with the actuator in the open position and the FPC in a separated state, as seen obliquely from back below.
Figure 12:
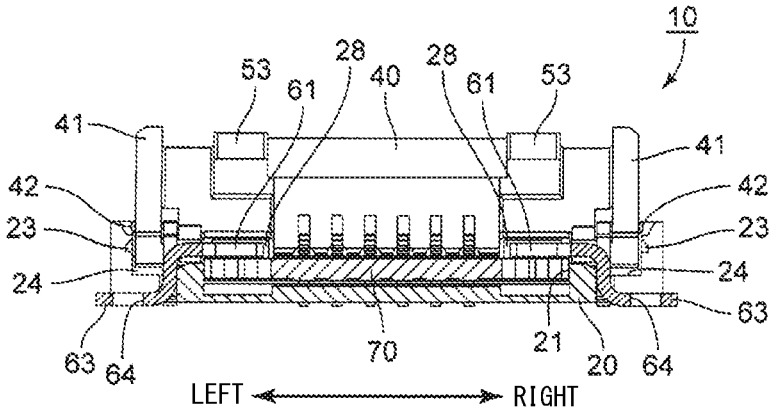
FIG. 12 is a sectional view along arrow XII-XII in FIG. 8.
Figure 13:
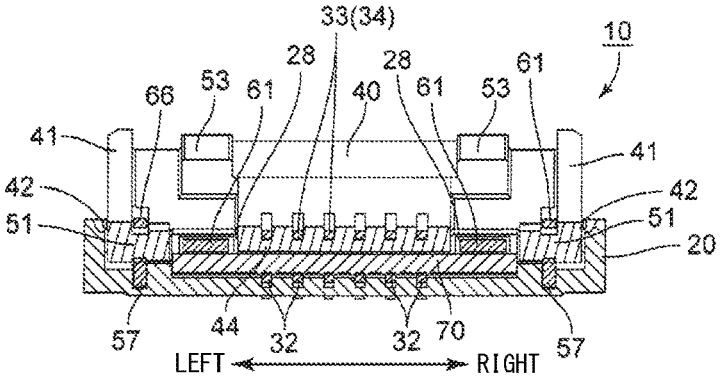
FIG. 13 is a sectional view along arrow XIII-XIII in FIG. 8.

The actuator 40 is attached to the signal contacts 30 (and the insulator 20) in the following manner: In a state where the actuator 40 is substantially orthogonal to the insulator 20 as illustrated in FIGS. 2 and 3, the base end (the center rotation shaft 44 side end) of the actuator 40 is inserted into the cable insertion groove 21 from the front and, while inserting the press arm 33 of each signal contact 30 into the corresponding arm insertion through hole 43, the support recess 34 is engaged with the center rotation shaft 44 (see FIGS. 11 and 16), and further the base ends of the right and left side arms 41 are situated in the right and left arm housing recesses 24 (see FIG. 12).

A pair of right and left fixed metal fittings 55 are obtained by press forming a metal plate, and each integrally include: a base portion 56 substantially arc-shaped in cross section; a press-fitted portion 57 extending backward from the base portion 56; a cable press piece 61 extending backward (the direction of inserting the FPC 70 into the cable insertion groove 21) from the inner edge of the base portion 56; a tail piece 63 extending laterally from the lower edge of the base portion 56; and a rotation shaft press piece 65 substantially L-shaped in a side view and projecting from the upper surface of the press-fitted portion 57. A stopper projection 58 is formed in the upper surface of the back part of the press-fitted portion 57. A support surface 59 which is a horizontal surface is formed in the upper surface of the front part of the press-fitted portion 57. A stopper projection escape recess 60 is formed between the front part of the inner edge of the base portion 56 and the front end surface of the cable press piece 61. The cable press piece 61 is a plate-like portion whose plate thickness direction is the up-down direction (parallel or substantially parallel to the thickness direction of the FPC 70, the term "parallel" in the claims including the meaning "substantially parallel"). The lower surface of the cable press piece 61 is a flat surface having a larger area than the plate thickness surface (the right and left surfaces) of the cable press piece 61 and orthogonal (or substantially orthogonal) to the up-down direction. The cable press piece 61 (and the base portion 56) has higher mechanical strength than the press arm 33 (signal contact 30), and so the cable press piece 61 is less elastically deformable in the up-down direction than the press arm 33. The upper part of the rotation shaft press piece 65 is formed by a substantially horizontal press portion 66.

Figure 10:
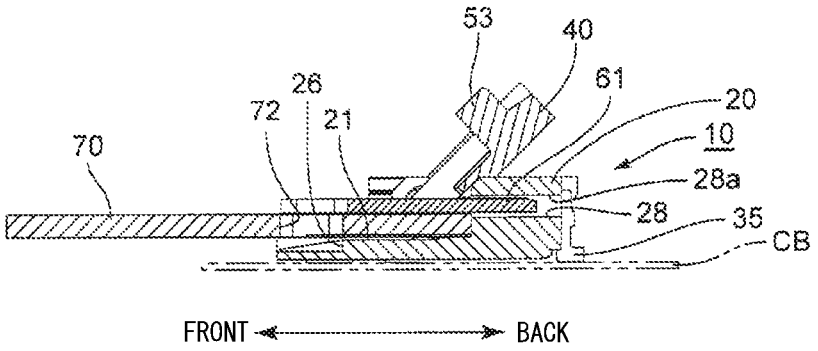
FIG. 10 is a sectional view along arrow X-X in FIG. 7.

Each fixed metal fitting 55 is fixed to the insulator 20 by press-fitting the press-fitted portion 57 into the corresponding one of the right and left metal fitting fixing grooves 25 from the front (the direction of inserting the FPC 70 into the insulator 20) while the tail piece 63 is located directly in front of the side wall 22 and the cable press piece 61 is located directly above the corresponding one of the right and left side edges of the cable insertion groove 21. When the press-fitted portion 57 is press-fitted into the metal fitting fixing groove 25, the stopper projection 58 formed in the upper surface of the press-fitted portion 57 digs into the upper surface of the back part of the metal fitting fixing groove 25. This fixes the fixed metal fitting 55 to the insulator 20 (see FIG. 9). Here, the lower surface of the tail piece 63 of the fixed metal fitting 55 is at the same height as the lower surface of the tail piece 35 of the signal contact 30. Moreover, the tip part (back end) of the cable press piece 61 of each of the right and left fixed metal fittings 55 passes through the corresponding one of the right and left metal fitting escape recesses 46 of the actuator 40 backward, and is inserted into the corresponding one of the right and left cable press piece insertion holes 28 of the insulator 20 from the front. As illustrated in FIG. 10, the plate thickness (up-down dimension) of the cable press piece 61 is slightly less than the up-down dimension of the cable press piece insertion hole 28, and the right-left width of the cable press piece 61 is slightly less than the right-left width of the cable press piece insertion hole 28. This creates a clearance in the up-down direction between a ceiling surface 28*a* (facing portion) constituting the upper surface of the cable press piece insertion hole 28 and the tip part of the cable press piece 61 (see FIGS. 10 and 15).

When each fixed metal fitting 55 is fixed to the insulator 20, the support surface 59 located higher than the bottom surface of the arm housing recess 24 rotatably supports the bottom part of the corresponding one of the right and left side rotation shafts 51 of the actuator 40 from below. Moreover, the press portion 66 of the rotation shaft press piece 65 faces the side rotation shaft 51 from above (from one side in the thickness direction of the FPC 70) with a clearance between the press portion 66 and the side rotation shaft 51 (see FIGS. 9 and 14). When the support surface 59 supports the corresponding one of the right and left side rotation shafts 51 in this way, the engaging relation between the support recess 34 of each signal contact 30 and the corresponding center rotation shaft 44 and the support state of the side rotation shaft 51 by the support surface 59 are maintained (by the downward elastic force of the press arm 33). This enables the actuator 40 to rotate about the center rotation shaft 44 and the side rotation shaft 51 relative to the insulator 20 (the insertion/removal direction of the FPC 70). In detail, the actuator 40 is rotatable between the open position where the actuator 40 is inclined slightly backward from the orthogonal position with the open position holding surface 49 abutting on the inclined support surface 29 of the insulator 20 (unlock position, the position illustrated in FIGS. 1, 5, and 7 to 13) and the closed position where the actuator 40 is inclined forward from the open position so that the whole actuator 40 is substantially horizontal (lock position, the position illustrated in FIGS. 6 and 14 to 18). When the actuator 40 rotates to the closed position, the right and left stopper projections 53 are fitted into the right and left rotation regulation recesses 26 of the insulator 20 from above, and the end surface of each stopper projection 53 abuts on the bottom surface of the corresponding rotation regulation recess 26. Thus, the downward rotation of the actuator 40 relative to the insulator 20 is regulated in the closed position by the rotation regulation recess 26 and the stopper projection 53. In addition, since the right and left locking projections 42 of the actuator 40 engage with the right and left closed position holding recesses 23 of the insulator 20, the actuator 40 is held in the closed position unless the actuator 40 is intentionally rotated to the open position.

The connector 10 can be mounted on the upper surface (circuit forming surface) of a circuit board CB (see the imaginary lines in FIGS. 9 to 11 and 14 to 16) substantially parallel to the front-back direction. In detail, the tail piece 35 of each signal contact 30 is placed on solder paste applied to a circuit pattern (not illustrated) on the circuit board CB, and the tail piece 63 of each of the right and left fixed metal fittings 55 is placed on solder paste applied to a part other than the circuit pattern on the circuit forming surface. Each solder paste is then heated to melt in a reflow furnace, to solder the tail piece 35 and the tail piece 63 to the circuit forming surface. This completes the mounting of the connector 10 on the circuit board CB.

Here, excess solder applied to the tail piece 63 may flow on the surface of the tail piece 63 and try to climb up to the base portion 56. However, this excess solder which has melted gathers in a solder escape hole 64 of the tail piece 63 by the effect of surface tension, and so the possibility of part of solder climbing up to the base portion 56 is low. Thus, solder does not adversely affect the opening-closing operation of the actuator 40.

The illustrated FPC 70 is removably insertable into the connector 10 having the structure described above.

As illustrated, the FPC 70 has a stack structure formed by bonding a plurality of thin film materials to each other, and includes: an end reinforcement member 71 constituting both ends of the FPC 70 in the longitudinal direction and harder than other parts; a stopper recess 72 formed at each of both side edges of the end reinforcement member 71; six circuit patterns 73 linearly extending along the extending direction of the FPC 70 to the lower surface of the end reinforcement member 71; and an insulating cover layer 74 covering entire both surfaces of the FPC 70 other than both ends of the circuit patterns 73. The part located directly behind the stopper recess 72 of the end reinforcement member 71 constitutes a locked portion 72*a*.

To connect the FPC 70 to the connector 10, first the actuator 40 is rotated to the open position, and then the back end of the FPC 70, while being located below each cable press piece 61, is inserted to the normal position (FIGS. 1, 6, 8, 9 to 11, and 14 to 16) with respect to the cable insertion groove 21. As a result, the right and left stopper recesses 72 of the FPC 70 are situated directly above the rotation regulation recesses 26 and the stopper projection escape recesses 60. Further, the right and left cable press pieces 61 face, from above (from one side in the thickness direction of the FPC 70), the right and left side edges of the part located more backward than the stopper recesses 72 of the FPC 70, with a clearance in between.

Figure 18:
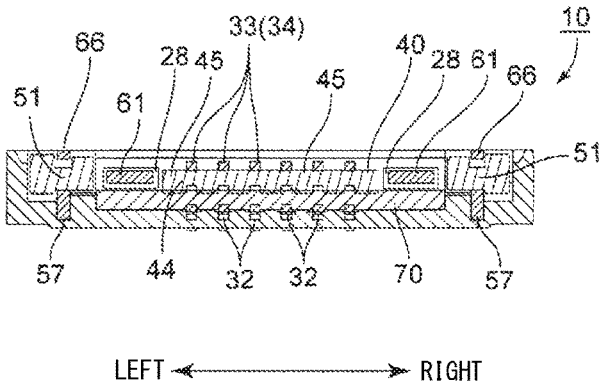
FIG. 18 is the same sectional view as in FIG. 13 when the actuator is rotated to the closed position.

When the actuator 40 is rotated forward to the closed position in this state, each cam portion 45 comes into surface contact with the upper surface of the FPC 70 and presses the FPC 70 downward (see FIG. 18). This ensures that each circuit pattern 73 of the FPC 70 is in contact with the contact projection 32 while elastically deforming the contact arm 31 of the corresponding signal contact 30 downward (see FIG. 16).

When the FPC 70 inserted in the insulator 20 moves in the removal direction in a state where the actuator 40 is in the closed position, the locked portion 72*a* located directly behind the stopper recess 72 of the FPC 70 abuts on the stopper projection 53 of the actuator 40. The stopper projection 53 can thus prevent the FPC 70 from disconnecting from the insulator 20.

Figure 19:
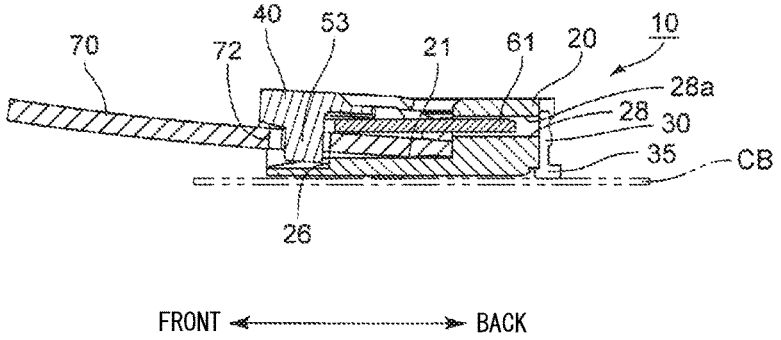
FIG. 19 is the same sectional view as in FIG. 15 when the back end of the FPC curls up by a force of a certain strength.

When an external force in the upward direction (curling-up direction) acts on the back end (the part located in the cable insertion groove 21 and the part directly in front of the former part) in a state where the actuator 40 is in the closed position, the back end of the FPC 70 moves upward relative to the insulator 20. The back end of the FPC 70 thus forces the actuator 40 to rotate slightly upward from the closed position (within the range where the engaging relation between the closed position holding recess 23 and the locking projection 42 is maintained) (see FIG. 19).

However, when the actuator 40 rotates slightly, the right and left sides of the back end of the FPC 70 come into contact with the lower surfaces of the right and left cable press pieces 61. Each cable press piece 61 is less elastically deformable (and less plastically deformable) (than the press arm 33), and has a large overlap area with the FPC 70 as seen in the up-down direction (the form of contact with the FPC 70 when the FPC 70 curls up tends to be surface contact). Accordingly, in the case where the upward moving force of the back end of the FPC 70 is not so strong, the upward movement (curling-up) of the back end of the FPC 70 can be reliably regulated in this position (see FIG. 19). The FPC 70 can thus be prevented from disconnecting from the insulator 20 (connector 10) due to curling-up.

Figure 20:
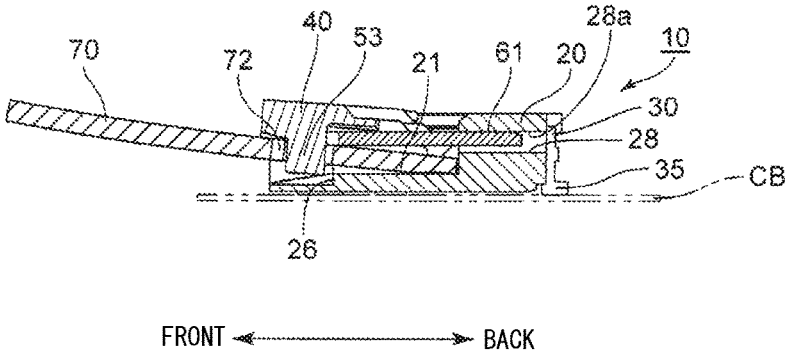
FIG. 20 is the same sectional view as in FIG. 15 when the back end of the FPC curls up by a very strong force.

In the case where the upward moving force of the back end of the FPC 70 is strong to a certain extent, the upward moving force of the back end of the FPC 70 causes the right and left cable press pieces 61 to elastically deform upward. As a result, the tip part of each cable press piece 61 abuts, from below, on the ceiling surface 28*a* (facing portion) facing the tip part of the cable press piece 61 from above (from the side opposite to the FPC 70) (see FIG. 20). In detail, the front end of the cable press piece 61 is supported by the base portion 56, and the back end of the cable press piece 61 engages with the ceiling surface 28*a* of the cable press piece insertion hole 28 (the front and back ends of the cable press piece 61 are double-supported). Moreover, the cable press piece 61 is made of metal (has higher mechanical strength than the press arm 33). Consequently, having engaged with the ceiling surface 28*a*, the cable press piece 61 hardly elastically deforms further upward. The cable press piece 61 can thus prevent the FPC 70 from disconnecting from the insulator 20 (connector 10) due to curling-up.

In the case where the external force in the curling-up direction acting on the back end of the FPC 70 inserted in the connector 10 where the actuator 40 is in the closed position is very strong (for example in the case where, during an assembly work of an electrical device or electronic device on which the connector 10 is mounted, a worker's hand or a an assembly tool is unexpectedly caught on FPC 70 and a strong momentary curling-up force acts on the FPC 70), the back end of the FPC 70, while deforming with the upper surface of the back end of each cable press piece 61 abutting on the ceiling surface 28*a* of the cable press piece insertion hole 28, passes between the right and left cable press pieces 61 and disconnects from the insulator 20 upward.

However, since the cable press piece 61 that is made of metal and has the front and back ends supported by the base portion 56 and the ceiling surface 28*a* of the cable press piece insertion hole 28 resists elastic deformation (and plastic deformation), the possibility of deformation or breakage of the cable press piece 61 in such a case is low.

When the back end of the FPC 70 disconnects from the insulator 20 upward, the back end of the FPC 70 may force the actuator 40 in the closed position to rotate to the open position while clearing the engaging relation between the closed position holding recess 23 and the locking projection 42. Since the actuator 40 absorbs the upward moving force of the FPC 70 through the rotation, however, the possibility of deformation or breakage of the actuator 40 (connector 10) in such a case is low.

In the case where the moving force of the FPC 70 forces the actuator 40 to rotate to the open position, the press arm 33 of the signal contact 30 elastically deforms upward by the center rotation shaft 44 of the actuator 40. In conventional connectors, this often causes the whole actuator 40 to be excessively raised upward relative to the insulator 20, as a result of which the press arm deforms plastically or the actuator falls off the insulator 20. In this embodiment, on the other hand, the right and left side rotation shafts 51 of the actuator 40 collide with the press portions 66 of the right and left fixed metal fittings 55, and so the press arm 33 is kept from further deformation or breakage. In addition, since the side rotation shaft 51 is embraced from the front and above by the substantially L-shaped rotation shaft press piece 65 made of metal, the possibility of the actuator 40 falling off the insulator 20 is low. Thus, even in the case where such an excessive external curling-up force that causes the FPC 70 to disconnect from the connector 10 in the curling-up direction acts on the FPC 70, the components (such as the fixed metal fittings 55) of the connector 10 are prevented from breakage and the actuator 40 is kept from falling off (the function as the connector can be maintained).

While the disclosed techniques have been described above by way of the embodiment, the disclosure is not limited to the foregoing embodiment, and various modifications are possible.

For example, the back end of the cable press piece 61 may be press-fitted into the cable press piece insertion hole 28 in a fixed state (the cable press piece insertion hole 28 in this case functions as "fixing portion"), by setting the up-down dimension of the cable press piece insertion hole 28 to be substantially the same as the up-down dimension (plate thickness) of the cable press piece 61 or by forming, at the back end of the cable press piece 61, a catching projection that digs into the inner wall of the cable press piece insertion hole 28.

Instead of or in addition to providing the cable press piece insertion hole 28 in the insulator 20, a forward projecting piece may be formed in the front end surface 20*a* of the back part of the insulator 20 (the projecting piece is located higher than the cable press piece insertion hole 28 in the case where the cable press piece insertion hole 28 is provided), where the projecting piece (facing portion) faces the cable press piece 61 from above or the projecting piece (fixing portion) engages with the cable press piece 61 from above in a fixed state.

The back end of the cable press piece insertion hole 28 may be blocked (by the back end of the insulator 20 as an example).

A slit (not illustrated) that reaches the upper end surface of the insulator 20 and whose right-left width is less than that of the cable press piece 61 may be formed in part of the ceiling surface 28*a* of the cable press piece insertion hole 28.

The back end of the cable press piece 61 and the cable press piece insertion hole 28 of the insulator 20 may be fixed to each other by other means (fixing portion). For example, a groove (fixing portion) whose upper end is open may be formed in the upper surface of the insulator 20, with the back end of the cable press piece 61 being press-fitted into the groove from above in a fixed state. The back end of the cable press piece 61 and the insulator 20 may be fixed to each other by an adhesive (fixing portion) or welding (such as heat welding or ultrasonic welding).

The bottom surface of each of the right and left arm housing recesses 24 of the insulator 20 may be located at the same height as or higher than the support surface 59 of the fixed metal fitting 55, to rotatably support the bottom of the side rotation shaft 51 by the bottom surface of the arm housing recess 24 or by the support surface 59 and the bottom surface of the arm housing recess 24.

The sheet-like cable may be a cable other than an FPC, such as a flexible flat cable (FFC).

INDUSTRIAL APPLICABILITY

The connector according to the disclosure can be widely used as a connector for connecting a sheet-like connection object such as a flexible flat cable (FFC) or a flexible printed circuit board (FPC).

REFERENCE SIGNS LIST

10 connector
20 insulator
20*a* front end surface of back part of insulator
21 cable insertion groove
22 side wall
23 closed position holding recess
24 arm housing recess
25 metal fitting fixing groove
26 rotation regulation recess
27 contact insertion groove
28 cable press piece insertion hole (fixing portion)
28*a* ceiling surface (facing portion)
29 inclined support surface
30 signal contact (contact)
31 contact arm
32 contact projection
33 press arm
34 support recess
35 tail piece
36 catching projection
40 actuator

41 side arm
42 locking projection
43 arm insertion through hole
44 center rotation shaft
45 cam portion
46 metal fitting escape recess
49 open position holding surface
50 side through hole
51 side rotation shaft (rotation shaft)
53 stopper projection
55 fixed metal fitting
56 base portion
57 press-fitted portion
58 stopper projection
59 support surface
60 stopper projection escape recess
61 cable press piece
63 tail piece
64 solder escape hole
65 rotation shaft press piece
66 press portion
70 FPC (sheet-like cable)
71 end reinforcement member
72 stopper recess
72*a* locked portion
73 circuit pattern
74 insulating cover layer
CB circuit board

The invention claimed is:

1. A cable connector comprising:

an insulator having a cable insertion groove into and from which a sheet-like cable is insertable and removable;

a contact supported by the insulator and coming into contact with one face of the cable in a thickness direction of the cable inserted in the insulator;

an actuator rotatable between a closed position and an open position relative to the insulator; and a fixed metal fitting fixed to the insulator, wherein the fixed metal fitting includes a cable press piece extending from a part of the fixed metal fitting in an insertion direction of the cable and facing the other face of the cable in the thickness direction of the cable, the cable press piece is shaped like a plate with a plate thickness direction parallel to the thickness direction of the cable, and the insulator includes a fixing portion fixing a tip part of the cable press piece or a facing portion facing the tip part from a side opposite to the cable, at least when the actuator is in the closed position.

2. The cable connector according to claim 1, wherein the insulator includes a cable press piece insertion hole into which the tip part of the cable press piece is inserted, and a part of an inner surface of the cable press piece insertion hole constitutes the facing portion.

3. The cable connector according to claim 1, wherein the actuator includes a rotation shaft as a rotation center thereof, and the fixed metal fitting includes a rotation shaft press piece facing the rotation shaft from the one side in the thickness direction of the cable.

4. The cable connector according to claim 1, wherein the cable includes a locked portion, the actuator includes a stopper projection facing, from a side to which the cable is to be removed, the locked portion of the cable inserted in the cable insertion groove when the actuator is in the closed position, and the fixed metal fitting includes a stopper projection escape recess into which the stopper projection is freely fitted when the actuator is in the closed position.

* * * * *